US005117988A

United States Patent [19]

Daniels

[11] Patent Number: 5,117,988

[45] Date of Patent: Jun. 2, 1992

[54] ACCESSORY HOLDING AND DISPLAYING DEVICE

[76] Inventor: Geraldine R. Daniels, 624 Ocean Dunes Cir., Jupiter, Fla. 33477

[21] Appl. No.: 698,305

[22] Filed: May 10, 1991

[51] Int. Cl.[5] ..... A47F 5/00

[52] U.S. Cl. ..... 211/113; 211/118; 211/89; 248/205.2

[58] Field of Search ..... 211/113, 118, 117, 13, 211/60.1, 89; 248/205.2; 206/495

[56] References Cited

U.S. PATENT DOCUMENTS

| | | | |
|---|---|---|---|
| 3,334,736 | 8/1967 | Cole et al. | 206/56 |
| 3,638,284 | 2/1972 | Baker . | |
| 3,688,348 | 9/1972 | Klotz et al. | 24/16 |
| 4,327,837 | 5/1982 | Ross | 211/87 |
| 4,387,873 | 6/1983 | Pavlo et al. | 211/113 X |
| 4,573,585 | 3/1986 | Frei | 211/13 |
| 4,654,991 | 4/1987 | Jones | 211/118 X |
| 4,682,691 | 7/1987 | Spiering | 206/373 |
| 4,690,288 | 9/1987 | Mitchell | 211/117 X |
| 4,749,088 | 6/1988 | Workman et al. | 211/118 X |
| 4,749,604 | 6/1988 | Foster | 428/100 |
| 4,799,587 | 1/1989 | Desanto | 206/37.6 |
| 4,932,626 | 6/1990 | Guillot | 248/548 |
| 4,971,593 | 11/1990 | Mayhall et al. | 211/13 X |

*Primary Examiner*—Robert W. Gibson, Jr.
*Attorney, Agent, or Firm*—Watov & Kipnes

[57] ABSTRACT

Fashion accessory holding device having a vertically extending base and a support system for the accessory in the form of removable loops so as to display the accessory along the base in a vertical orientation.

19 Claims, 2 Drawing Sheets

ACCESSORY HOLDING AND DISPLAYING DEVICE

FIELD OF THE INVENTION

This invention relates to a means and method for hanging and displaying accessory items such as clip-bows, head bands, scrunchies, banana clips, hair crimping type accessory, ponytail holders, rings, earrings, necklaces, scarves, and the like in an organized and aesthetically appealing fashion.

BACKGROUND OF THE INVENTION

Fashion accessories such as hair and jewelry items are typically stored in a drawer, box or other similar container in a haphazard manner. Consequently, not only are the accessories hard to find but people often forget what accessories they have, particularly those at the bottom of the container. It is also common for particularly delicate accessories to become damaged. Thus there is a need to provide an effective way to store and display such accessories.

There are a variety of racks currently available for hanging such articles as ties, scarves, belts, and keys. However, these devices suffer from numerous disadvantages. The loops, bars or rods upon which the articles are hung are often permanently affixed to the base of the rack. This makes removal of the desired article difficult and time consuming particularly when other articles must be moved to gain access.

The loops, bars or rods are usually affixed in pre-set positions. This is disadvantageous because these preset components do not allow for efficient use of the available area since fashion accessories have a wide variety of shapes and sizes. Such devices fail to display accessories in as small a space as possible while retaining ease of access and visibility. Additionally, many of the existing racks are arranged horizontally which is not effective utilization of existing space.

In overcoming some of these disadvantages, hanging devices which enable the fastening of accessories in varying locations on a rack through the use of a commercially sold material called VELCRO have been developed such as shown and described in Ross, U.S. Pat No. 4,327,837 and Foster, U.S. Pat No. 4,749, 604. These hanging devices however still have the disadvantage of being oriented horizontally and as a result take up more space than is necessary.

The present invention is adapted to hold and display fashion accessories vertically allowing for flexible storage capacity. The present device occupies minimal space and may be retained in a variety of convenient locations often not readily available to customary rigid horizontal racks.

Accordingly, an object of the present invention is to provide a means to store and display fashion accessories including jewelry and ornamental items for the hair so that they are organized, free from damage and readily accessibly to the user.

SUMMARY OF THE INVENTION

The present invention is generally directed to an accessory holding device comprising a vertically extending base, a first securing means attached to at least one side of the base and at least one strip of a second securing means adapted to be removably fastened to the first securing means in the form of at least one loop for orienting the accessory along the vertically extending base.

In preferred form of the invention the first securing means comprises a material having a multitude of minute loops projecting from the material and the second securing means comprises a material having a multitude of minute hooks projecting from the material such that the hooks are adapted to engage the minute loops enabling the first securing means to be releasably attached to the second securing means. The strength of this attachment is sufficient to hold a fashion accessory along the axis of the vertically extending base. The preferred material for the first and second securing means is commercially available under the trademark VELCRO.

The accessory holding device may further comprise means attached to one end of the base, preferably the top end, which is adapted to suspend the device. The suspension means may include a ring, a clip, a hanger or the like.

The second securing means extends in at least one strip along the longitudinal axis of the base. Multiple strips of varying length may be used. In either case, however, the second securing means may be formed into a number of loops with each loop used to hold and display at least one fashion accessory.

The strips are preferably stored on the first securing means in a fully extended, non-loop forming position attached along their entire length to the first securing means. The strips may then be lifted at one end and the lifted end moved closer to its opposed end to form the loop where only the ends of the strip are attached to the first securing means. Accordingly, the strips may be partially overlapped during storage in their fully extended position.

The accessory holding device of the present invention may also provide for the first securing means to be attached to both sides of the base so that accessories may be hung on both sides of the device. In this embodiment, the second securing means is provided on both sides of the base to enable the formation of separate sets of loops for hanging the accessories. The present device may also comprise more than one parallel row of strips attached to one or both sides of said base which provides even greater capacity for holding the fashion accessories.

The accessory holding device may be constructed in a manner which enhances its appearance particularly for sale in high fashion accessory stores. This can be accomplished in part by attaching a decorative fabric such as lace along the perimeter of the base.

In another aspect of the present invention there is provided a method of holding or displaying fashion accessories utilizing the accessory holding device described above. The method comprises suspending the vertically extending strip of the first securing means, disengaging the second securing means from the first securing means, placing the accessory item on the first securing means, placing the second securing means over the accessory in the form of a loop and engaging the first and second securing means to each other to secure the fashion accessory in a vertical orientation against the base. A fashion accessory such as a scarf may be removed from the device by merely pulling it through the loop. Ring-type accessories such as earrings may be released by disengaging the second securing means from the first securing means so as to release the loop.

BRIEF DESCRIPTION OF THE DRAWINGS

The following drawings in which like reference characters indicate like parts are illustrative of embodiments of the invention and are not intended to limit the scope of the invention as encompassed by the claims forming part of the application.

DETAILED DESCRIPTION OF THE INVENTION

Figure 1:
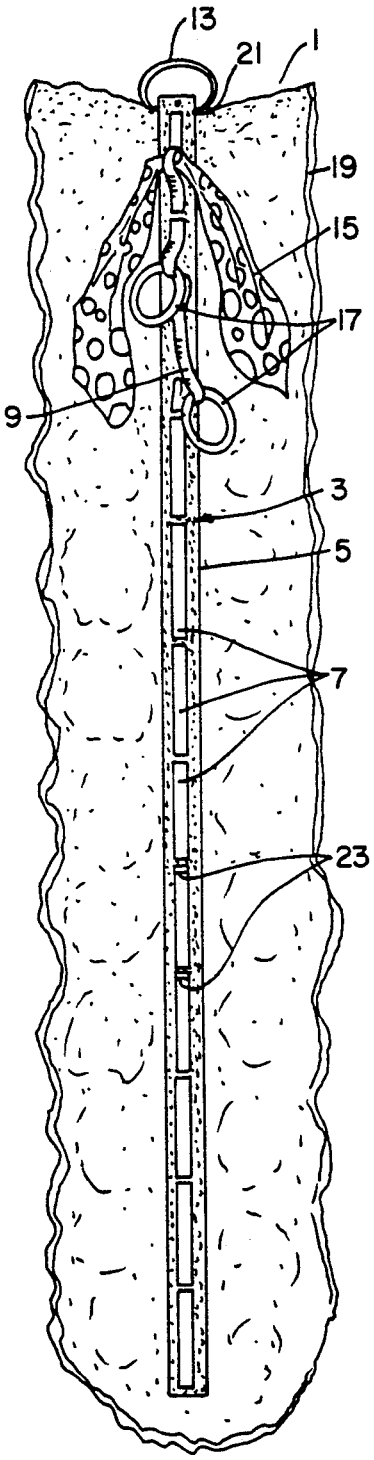
FIG. 1 is a front view of an embodiment of the accessory holder device of the present invention with fashion accessories hanging therefrom.
Figure 2:
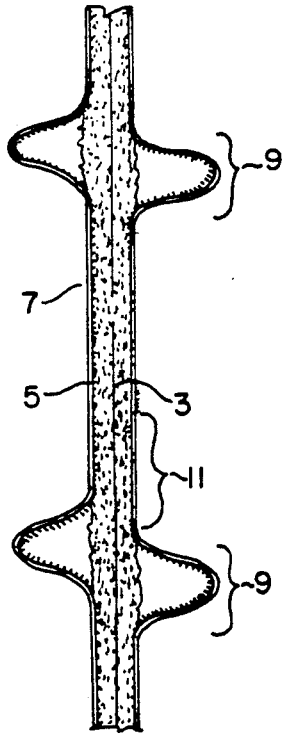
FIG. 2 is a side view of the embodiment shown in FIG. 1 showing several strips of a second securing means arranged in the form of a loop.

Referring to the drawings and particularly to FIGS. 1 and 2 there is shown a preferred embodiment of the invention for holding and displaying a variety of accessories exemplified by numerals 15 (scarf) and 17 (earrings).

The accessory holding device 1 includes a base 3 having a generally elongated rectangular shape. The base 3 is preferably made of any type of flexible material such as fabric which can have other materials readily attached to it.

A first securing means 5 is attached to the base 3 by any of a number of conventional methods such as sewing, gluing or stapling. The first securing means 5 covers at least substantially the entire length of the base 3 to provide a surface for the releasable attachment of a second securing means 7. The first securing means 5 is preferably rectangular in shape and approximately 12 to 48 inches in length.

Figure 4:
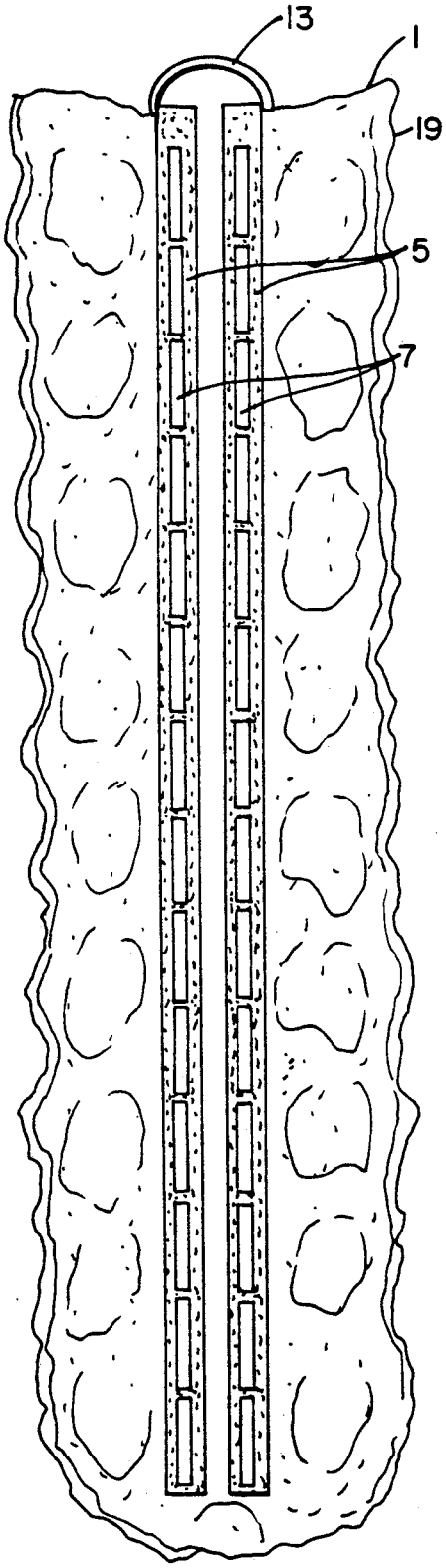
FIG. 4 is a front view of another embodiment of the present invention having two rows of a first securing means and multiple strips of a second securing means affixed thereon.

The first securing means 5 is attached to the base 3. The first securing means 5 can be placed on the base 3 in a variety of ways; on one side of the base 3 as shown in FIG. 1; on both sides of the base 3 as shown in FIG. 2; and/or in multiple parallel columns on the base 3 as shown in FIG. 4. This allows for the most efficient use of the space in which the device 1 is located and accommodates varying accessories 15 and 17 which will be hung from the device 1.

A second securing means in the form of strips 7 is provided which is adapted to releasably attach to the first securing means 5 and can be formed into accessory holding loop closures 9 by the user as shown best in FIGS. 1 and 2.

Figure 3:
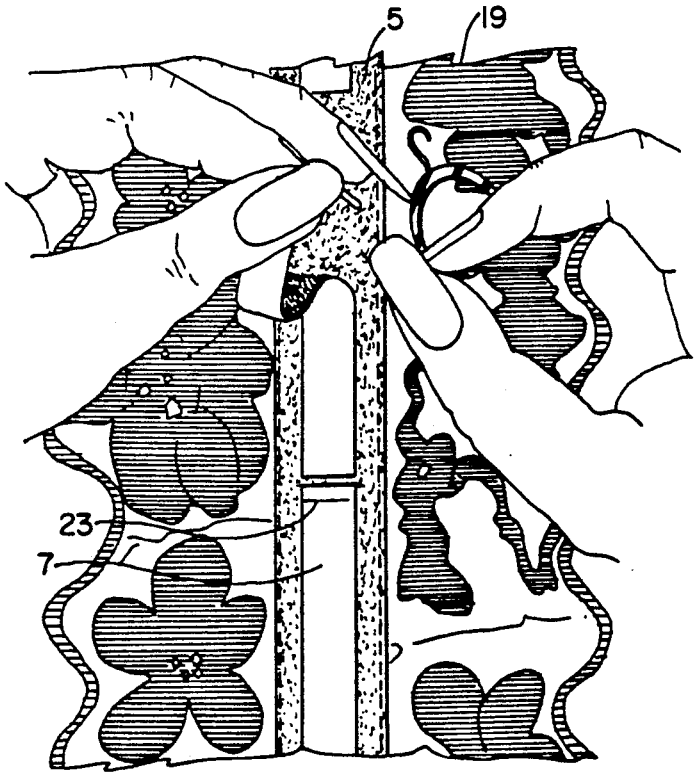
FIG. 3 is a partial front view of the embodiment of FIG. 1 showing how an accessory is placed on the accessory holding device.

The strips 7 can be in the form a single strip (shown in FIG. 5) attached along the length of the first securing means 5 or in the form of a plurality of strips 7 of the same or different lengths as shown in FIG. 3. The strips 7 can have one end permanently secured to the first securing means 5 by a thread 23 as shown in FIG. 3 or the strips 7 can be completely removable from the first securing means 5. The length occupied by the strips 7 of the first securing means 5 decreases when the strips 7 go from their elongated non-loop position 11 to the loop closure 9 position shown in, for example, FIG. 2. Accordingly, the strips 7 may be made to overlap when stored on the device in the elongated non-loop position 11.

In a preferred embodiment, the first securing means 5 is made of a material having a multitude of minute outwardly extending loops. The strips 7 are then preferably of a material having a multitude of outwardly extending hooks. When pressed together the hooks and the loops engage each other creating an adjustable loop closure 9. To open the closure 9, the respective materials are peeled apart, thereby disengaging the loops and hooks as shown in FIG. 3. The preferred hook and loop material is sold under the trademark "VELCRO".

Figure 5:
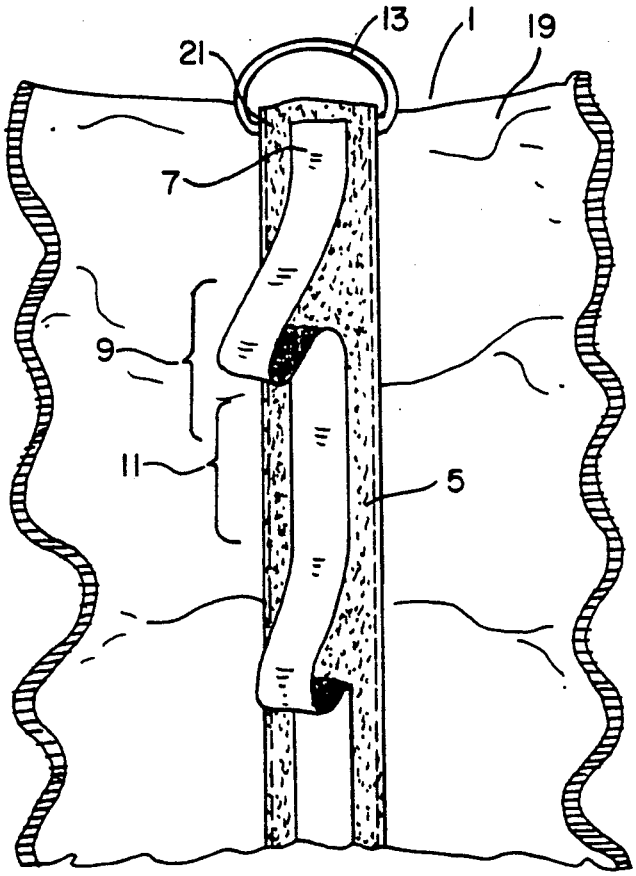
FIG. 5 is an enlarged partial front view of a further embodiment of the invention showing a single strip of the second securing means forming more than one loop.

In the embodiment shown in FIGS. 1, 4 and 5, the top end 21 of the device 1 is provided with a ring 13 or similar item such as a pin or material with an adhesive backing for suspending the device in an operative vertical orientation. The ring 13 may be made from metal, leather, fabric, elastic, and the like and enables the accessory holding device 1 to be hung vertically on a wall, the back of a door, in a closet, on a hanger, or the like for residential use with the accessories 15 and 17 displayed in full view and readily accessible. Because of its construction from flexible material, the device 1 may be folded or hung in a garment bag making it ideal for storing fashion accessories while traveling.

The accessory holding device can also be adapted for commercial displays such as a fixed carousel, a rotatable display unit or a vanity. It may also be placed on a large display column such as commonly used in fashion accessory boutiques.

To enhance the appearance of the device 1, a decorative material 19 such as lace or patterned fabric may be attached to the base 3 such as shown in FIGS. 1 and 3. The decorative material 19 acts as a hem or border and is designed to attract attention to the device 1. The decorative material 19 is preferably attached to the perimeter of the base 3 prior to the attachment of the first securing means 5 to the base 3. Attachment is made by conventional methods such as gluing, sewing, taping or stapling. Since both sides of the device 1 may be used for hanging accessories the decorative material 19 may have a double sided design. Additionally, the decorative material 19 should be sufficiently stiff so that it does not droop when the device 1 is hanging.

In operation, the accessory holding device 1 may be suspended by way of the ring 13 on the wall or door of a closet. Once a person has decided what they are going to be wearing, they select the fashion accessory 15 or 17 which will compliment and enhance their appearance. The device enables the individual to have a full perspective of the displayed fashion accessories and determine if the accessory, 15, 17 actually matches the outfit prior to removing it from the device 1.

Once the selection of the accessory is made, the individual can remove the accessory by one of two means. If the fashion accessory (e.g. a scarf) it can be removed from the loop closure 9 by simply pulling the accessory from one end until it moves out of the loop closure 9. Earrings and other solid ring accessories are removed by disengaging the loop closure. This is done by lifting one end of the strip 7 until it disengages from the first securing means 5, until the accessory is able to be removed from the disengaged end of the strip 7.

To hang a fashion accessory onto the accessory holding device 1 one can slide the open end of an accessory (e.g. a scarf) over an existing loop closure 9. If the accessory (e.g. an earring) can not be hung from the device in this manner or there is no existing loop closure 9, then one end of the elongated strip 7 can be lifted up from the first securing means 5 to allow access by the accessory 15 or 17. The lifted end of the strip 7 is then placed over the accessory 15, 17 and secured to the first securing means 5 to form a loop closure 9 around the accessory 15, 17.

The length of a strip 7 which is necessary to support a particular accessory can vary depending on the size and weight of the accessory 15 and 17. For example, the loop closure 9 needed to enclose an earring 17 is much smaller than the loop closure is needed to enclose a scarf 15. Additionally, more than one loop closure 9 can be used to hold a single accessory, particularly for heavy accessories such as a handbag and more than one loop closure 9 can be formed from one of the strips 7. It should also be noted that the support provided by the present device is made without the first or second securing means attaching to the accessory.

Many variations of the present invention will suggest themselves to those skilled in the art in light of the above detailed description and accompanying drawings. All such obvious modifications are within the full intended scope of the claims.

I claim:

1. A fashion accessory holding device comprising:
a) a vertically extending base having two sides;
b) a first securing means attached to both sides of said base; and
c) at least one strip of a second securing means adapted to be removably engaged to said first securing means along the longitudinal axis of the vertically extending base in the form of a loop.

2. The accessory holding device as defined in claim 1 wherein the first securing means comprises a material having a multitude of loops or hooks projecting from said material and said second securing means comprises a material having the other of said loops and hooks projecting from said material wherein the loops and hooks are adapted to removably engage each other.

3. The accessory holding device as defined in claim 1 further comprising means attached to one end of the base for suspending the device in a vertical orientation.

4. The accessory holding device as defined in claim 1 comprising at least two rows of second securing means attached to said first securing means.

5. The accessory holding device as defined in claim 1 comprising at least two parallel rows of said first securing means attached to one side of said base.

6. The accessory holding device as defined in claim 1 wherein said second securing means comprises a plurality of separate strips of varying lengths covering at least a substantial length of the first securing means.

7. The accessory holding device as defined in claim 1 wherein the second securing means has opposed ends, one of said ends being permanently attached to the first securing means.

8. The accessory holding device as defined in claim 1 wherein said second securing means is in the form of a plurality of separate loops along the first securing means.

9. The accessory holding device as defined in claim 1 wherein said second securing means is adapted to be secured to the first securing means along the entire length of the first securing means and to be released in part from the first securing means to form said loop.

10. The accessory holding device as defined in claim 7 wherein the strips of the second securing means are attached to the first securing means over its entire length and wherein at least some of the strips of said second securing means overlap each other.

11. A fashion accessory holding device comprising:
a) a vertically extending base;
b) a first securing means attached to at least one side of said base; and
c) at least two rows of at least one strip of a second securing means adapted to be removably engaged to said first securing means along the longitudinal axis of the vertically extending base in the form of a loop.

12. The accessory holding device as defined in claim 11 wherein the first securing means comprises a material having a multitude of loops or hooks projecting from said material and said second securing means comprises a material having the other of said loops and hooks projecting from said material wherein the loops and hooks are adapted to removably engage each other.

13. The accessory holding device as defined in claim 11 comprising at least two rows of said second securing means attached to said first securing means.

14. A fashion accessory holding device comprising:
a) a vertically extending base;
b) at least two parallel rows of a first securing means attached to at least one side of said base; and
c) at least one strip of a second securing means adapted to be removably engaged to said first securing means along the longitudinal axis of the vertically extending base in the form of a loop.

15. The accessory holding device as defined in claim 14 wherein the first securing means comprises a material having a multitude of loops or hooks projecting from said material and said second securing means comprises a material having the other of said loops and hooks projecting from said material wherein the loops and hooks are adapted to removably engage each other.

16. A fashion accessory holding device comprising:
a) a vertically extending base;
b) a first securing means attached to at least one side of said base; and
c) at least one strip of a second securing means having opposed ends, one of said ends being permanently attached to the first securing means, said second securing means adapted to be removably engaged to said first securing means along the longitudinal axis of the vertically extending base in the form of a loop.

17. The accessory holding device as defined in claim 16 wherein the first securing means comprises a material having a multitude of loops or hooks projecting from said material and said second securing means comprises a material having the other of said loops and hooks projecting from said material wherein the loops and hooks are adapted to removably engage each other.

18. The accessory holding device as defined in claim 16 wherein the strips of the second securing means are attached to the first securing means over its entire length and wherein at least some of the strips of said second securing means overlap each other.

19. A fashion accessory holding device comprising:
a) a vertically extending base;
b) a first securing means attached to at least one side of said base; and
c) at least one strip of a second securing means adapted to be removably engaged to said first securing means along the entire length of the longitudinal axis of the vertically extending base and to be released in part from the first securing means to form a loop.

* * * * *